US009127474B2

(12) United States Patent
Tinwala

(10) Patent No.: US 9,127,474 B2
(45) Date of Patent: Sep. 8, 2015

(54) RAILING SYSTEM

(71) Applicant: VIVA Railings, LLC, Carrollton, TX (US)

(72) Inventor: Murtuza Tinwala, Flower Mound, TX (US)

(73) Assignee: VIVA RAILINGS, LLC, Carrollton, TX (US)

( * ) Notice: Subject to any disclaimer, the term of this patent is extended or adjusted under 35 U.S.C. 154(b) by 0 days.

(21) Appl. No.: 14/152,612

(22) Filed: Jan. 10, 2014

(65) Prior Publication Data

US 2015/0197959 A1 Jul. 16, 2015

(51) Int. Cl.
*E04H 17/16* (2006.01)
*F16B 2/10* (2006.01)

(52) U.S. Cl.
CPC ..... *E04H 17/16* (2013.01); *Y10T 403/7067* (2015.01)

(58) Field of Classification Search
USPC ..... 403/374.3, 409.1; 256/24, 31, 68–70, 256/73; 52/204.65, 767
See application file for complete search history.

(56) References Cited

U.S. PATENT DOCUMENTS

| | | | | |
|---|---|---|---|---|
| 2,954,638 | A * | 10/1960 | Motter | 256/65.01 |
| 3,121,261 | A * | 2/1964 | Ritter, Jr. | 52/204.595 |
| 3,989,133 | A | 11/1976 | Courson et al. | |
| 4,054,268 | A * | 10/1977 | Sher | 256/24 |
| 4,671,016 | A * | 6/1987 | Boeckx | 52/767 |
| 5,156,251 | A | 10/1992 | Johnson | |
| 6,419,209 | B1 * | 7/2002 | Shepherd | 256/24 |
| 6,434,905 | B1 | 8/2002 | Sprague | |
| 6,517,056 | B2 | 2/2003 | Shepherd | |
| 7,036,799 | B2 | 5/2006 | Shepherd | |
| 7,559,536 | B1 * | 7/2009 | Hansen et al. | 256/25 |
| 7,584,588 | B2 * | 9/2009 | Kim | 52/204.65 |
| 7,730,682 | B2 | 6/2010 | Nash | |
| 7,963,077 | B2 * | 6/2011 | Lin | 52/204.65 |
| 8,181,405 | B2 * | 5/2012 | Nash | 52/238.1 |
| 8,500,110 | B2 | 8/2013 | Allen | |
| 8,826,621 | B2 * | 9/2014 | Noble | 52/767 |
| 2010/0307082 | A1 | 12/2010 | Nash | |
| 2012/0299233 | A1 * | 11/2012 | Header | 269/91 |
| 2013/0248792 | A1 * | 9/2013 | Bangratz | 256/24 |
| 2014/0086680 | A1 * | 3/2014 | Header | 403/374.3 |

FOREIGN PATENT DOCUMENTS

| | | |
|---|---|---|
| EP | 0736478 A2 | 10/1996 |
| EP | 1818476 A1 | 8/2007 |
| EP | 2186965 A1 | 5/2010 |

OTHER PUBLICATIONS

PCT Search Report and Written Opinion from PCT/US2015/010818 mailed May 5, 2015 (8 pages).

* cited by examiner

*Primary Examiner* — Daniel P Stodola
*Assistant Examiner* — Josh Skroupa
(74) *Attorney, Agent, or Firm* — Colin P. Cahoon; Shaukat A. Karjeker; Carstens & Cahoon, LLP

(57) ABSTRACT

A railing system for mounting a panel or series of panels to form a railing. The railing system is comprised of the following base components: a shoe, which may be secured to the floor, having a slot for receiving a glass panel, a sleeve that holds the glass panel within the shoe, an arm that is adjustable to provide the force necessary to hold the glass panel in the desired position, and at least one set screw that adjusts the arm and holds the arm in place, in turn bracing the glass panel in the desired position.

20 Claims, 4 Drawing Sheets

RAILING SYSTEM

BACKGROUND OF THE INVENTION

1. Technical Field

The present invention relates to a mounting system for panels, more specifically, glass panels.

2. Description of Related Art

Glass panels or similarly transparent or semi-transparent panel are conventionally used to form railing systems such as for a stairway or walkway. Mounting the glass panels without damaging the glass panels has proved a challenge with the installation and repair of these railing systems. Thus, it is desirable to have a system for mounting glass panels, or the like, securely and non-destructively in a railing system, while providing an avenue for the removal, repair, and re-installation of the panels at a later day.

SUMMARY OF THE INVENTION

The present invention is a railing system for mounting a panel or series of panels to form a railing. The railing system is comprised of the following base components: a shoe, which may be secured to the floor, having a slot for receiving a glass panel, a sleeve that holds the glass panel within the shoe, an arm that is adjustable to provide the force necessary to hold the glass panel in the desired position, and at least one set screw that adjusts the arm and holds the arm in place, in turn bracing the glass panel in the desired position.

The shoe has a generally U-shaped, upward opening slot defined by a first side wall, a second side wall, and a lower wall. A sleeve for holding and cushioning the lower edge of glass panel fits within the slot of the shoe. An adjustable arm is rotatably mounted within a circular channel in the first side wall. The arm extends to and engages the adjacent side of the panel, bracing it against the sleeve. The arm is adjusted and held in place by at least two set screws which extend generally diagonally through the first side wall 104 and contact the arm.

The claimed system provides a secure and non-destructive means of mounting glass panels. An advantage of the claimed system is the ease of installation and the ability to remove the individual panels for repair without disturbing the remainder of the panels or damaging other components of the system. The claimed system is especially advantageous when mounting panels on an incline as compared to some prior art systems utilizing concrete.

BRIEF DESCRIPTIONS OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Several embodiments of Applicants' invention will now be described with reference to the drawings. Unless otherwise noted, like elements will be identified by identical numbers throughout all figures. The invention illustratively disclosed herein suitably may be practiced in the absence of any element which is not specifically disclosed herein.

The claimed invention provides a system for mounting a panel or series of panels to form a railing, such as a hand rail or guard rail. The railing system is primarily intended for mounting glass panels or partitions, but does not preclude the use of other panels, such as panels from ecoresin, acrylic, polycarbonate, plywood, and particle Board. The use of the term "glass panel" herein should not be read as limiting and the terms "panel" and "partition" are used interchangeably. The claimed system provides a secure and non-destructive means of mounting glass panels. An advantage of the claimed system is the ease of installation and the ability to remove the individual panels for repair without disturbing the remainder of the panels or damaging other components of the system. The claimed system is especially advantageous when mounting panels on an incline as compared to some prior art systems utilizing concrete.

Figure 1:
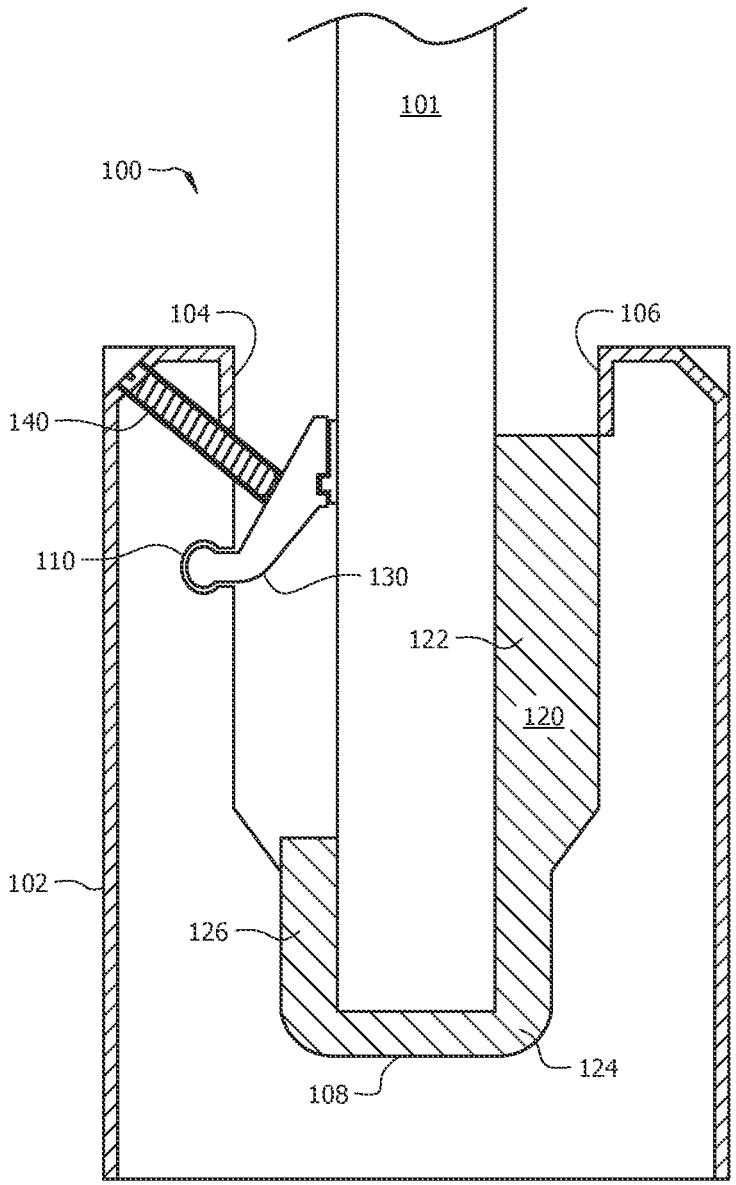
FIG. 1 is a schematic elevation view of the inventive railing system.

With reference to FIG. 1, the railing system 100 is comprised of the following base components: a shoe 102, which may be secured to the floor, having a slot for receiving a glass panel 101, a sleeve 120 that holds the glass panel 101 within the shoe 102, an arm 130 that is adjustable to provide the force necessary to hold the glass panel 101 in the desired position, and at least one set screw 140 that adjusts the arm 130 and holds the arm 130 in place, in turn bracing the glass panel 101 in the desired position.

The shoe 102 has a generally U-shaped, upward opening slot defined by a first side wall 104, a second side wall 106, and a lower wall 108. The width of the slot may be determined by one skilled in the art to accommodate the desired thickness of the glass panel and provide the required stability for the panel. When the glass panel 101 is inserted into the slot, the lower edge of the panel 101 is adjacent to the lower wall 108 of the shoe 102, and each side of the panel 101 is adjacent to the side walls 104, 106 of the shoe 102. In one embodiment, the shoe 102 is made of aluminum, but it may be constructed of any durable material known in the art. To make the outer walls of the shoe more aesthetic, a finish such as anodizing or powder coating may be used or cladding may be attached. The shoe is capable of being secured to the base floor by any means known in the art.

A sleeve 120 for holding and cushioning the lower edge of glass panel 101 fits within the slot of the shoe 102. In one embodiment, the sleeve is made of a malleable material that may conform to the surface of the panel sides. Use of such compliant materials for the sleeve will permit more durable and rigid materials to be used to form the shoe 102 as these harder materials are not in contact with the panel 101 and thus cannot scar, scratch, score or otherwise harm the aesthetics or integrity of the panel. An example of a suitable material for the sleeve 120 is EPDM, Nylon, HDPE or other suitable grade of plastic, but it may be any material that provides a cushion for the glass panel 101 and will not scar or score the panel 101 from contact. The sleeve 120 is designed to fit securely within the slot and preferably contacts at least the second side wall 106 and lower wall 108 to ensure a steady and non-destructive base for the glass panel 101. In one embodiment, the sleeve 120 has a first vertical portion 122 that extends between the second side wall 106 and the adjacent side of the panel 101, and a lower portion 124 between the lower edge of the panel 101 and the lower wall 108 of the shoe 102. The sleeve 120 may also have a second vertical portion 126 between the first side wall 104 and the adjacent side of the panel 101. The vertical portion 122 preferably extends the entire height of the second side wall 106, while the second vertical portion 126 only partially extends the height of the first side wall 104.

An adjustable arm 130 is rotatably mounted within a circular channel 110 in the first side wall 104. The arm 130 extends to and engages the adjacent side of the panel 101, bracing it against the sleeve 120. The arm is adjusted and held in place by at least two set screws 140 which extend generally diagonally through the first side wall 104 and contact the arm 130. The set screws 140 cause the arm 130 to engage the panel 101 and apply the force necessary to hold the panel 101 in the desired position. In a preferred embodiment, the set screws 140 are made of SS 304 and are approximately 20 mm long with a hex drive on the top for tightening. The end of the set screw 140 is accessible from the upper portion of the outer wall of the shoe 102 to allow the screw to be tightened or loosened and the arm adjusted. The number of set screws 140 needed in the railing system depends on the length of the arm 130, and the dimensions and weight of the panel. Generally, in a preferred embodiment, the set screws 140 are spaced at every 8 inches apart for a glass panel with a thickness of 0.5 inches. As one skilled in the art will understand, the number and spacing of the set screws 140 may be adjusted based on the particular features and dimensions of the panel used.

Cooperation between the sleeve and the arm allows the panel to be laterally positioned as desired within the slot. As shown in FIG. 1, panel 101 is generally centered within the slot, but it may be desirable to have the panel 101 offset closer to one or the other side walls, and manipulation of the thickness of the sleeve may permit some degree of offset.

Figure 2:
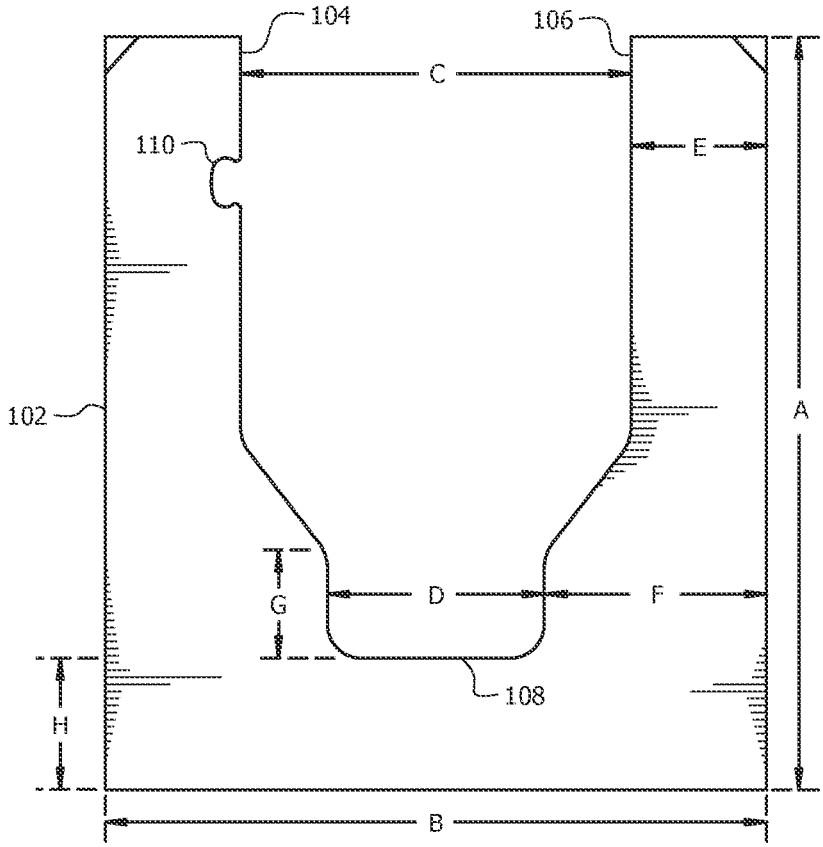
FIG. 2 is a schematic elevation view of one component of the inventive railing system.

With reference to FIG. 2, the shoe 102 is generally U-shaped, with an upward opening slot for receiving a panel 101. In a preferred embodiment, the slot is wider at its opening than its terminal. The slot is narrower at the bottom to more securely hold the panel within the slot. The inner surfaces of side walls 104, 106 slope inward and downward for a short distance before continuing vertically until the lower wall 108 is met. A further advantage of this feature is that the wider width of the side walls 104, 106 at their lower ends provide a more stable base for the railing system.

One skilled in the art will be able to determine the optimum shape and dimensions for the shoe 102 based on the panel that will be used in the railing system. The following dimensions are given as a guide and should not be read as limiting. In one embodiment, the shoe 102 has a height A of about 3.5 to about 4.0 inches and a width B of about 2.3 to about 2.6 inches. The opening of the slot has a width C of about 1.3 to about 1.5 inches and the terminal of the slot has a width D of about 0.9 to about 1.1 inches. The upper portion of side walls 104, 106 have a thickness E of about 0.5 to about 0.6 inches, and the lower portion of side walls 104, 106 have a thickness F of about 0.7 to about 0.8 inches and a height G of about 0.9 to about 1.0 inches. The upper portion of side walls 104, 106 slope downward at about 45° to meet the lower portion of side walls 104, 106. The distance H between lower wall 108 and the base of shoe 102 is about 0.7 to about 0.8 inches.

In the first side wall 104 there is a circular channel 110 adapted to rotatably hold the arm 130. One skilled in the art will be able to determine where in the first side wall 104 the channel 110 should be placed and the dimensions of the channel 110. In one embodiment, the center of the circular channel 110 is set within the first side wall about 0.1 to about 0.15 inches from the internal surface of the first side wall 104 and about 3.0 to about 3.1 inches high on the side wall 104. The diameter of the circular channel 110 is about 0.2 to about 0.3 inches.

Figure 3:
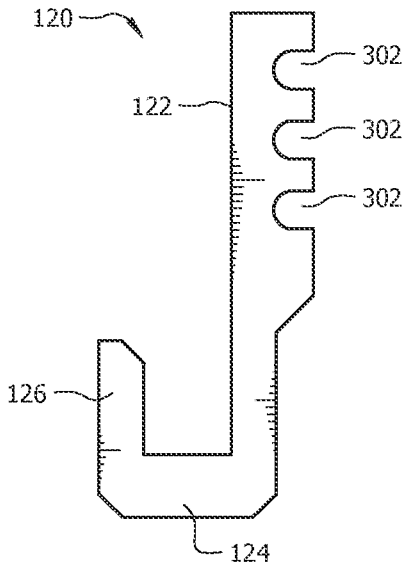
FIG. 3 is a schematic elevation view of one component of the inventive railing system.

The sleeve 120 is depicted in more detail in FIG. 3. Sleeve 120 is generally J-shaped, but could also be generally U-shaped. The sleeve 120 is manufactured in light of the specific dimensions of the shoe 102 such that it mates with the inner surfaces of the side walls 104, 106 and lower wall 108. In one embodiment, the sleeve 120 is comprised of a first vertical portion 122, lower portion 124, and second vertical portion 126. The first vertical portion 122 extends the entire height of the second side wall 106 and is flush with the second side wall 106 to fully cushion and insulate the panel 101 from contact with the shoe 102. The lower portion 124 sits within the narrowed portion of the slot and rests upon the lower wall 108. The second vertical portion 126 extends only partially up the first side wall 104. In a preferred embodiment, the second vertical portion terminates at the point at which the first side wall 104 widens to form the widened portion of the slot as shown in FIG. 1. One skilled in the art may determine the optimum length of the second vertical portion 126 of the sleeve 120, but the height of the second vertical portion 126 must be less than the height of the lower edge of the circular channel 110 in order not to impede the movement of arm 130. The distance between the first vertical portion 122 and second vertical portion 126 should be the width of the panel 101 in order to securely hold and cushion the lower edge of the panel 101 within the sleeve 120. In one embodiment, the first vertical portion 122 has at least one groove 302 in its external surface as shown in FIG. 3. These grooves 302 reduce the amount of material required to form the sleeve 120, making the sleeve 120 lighter. The grooves 302 also provide a better grip to the side wall 106.

Figure 4:
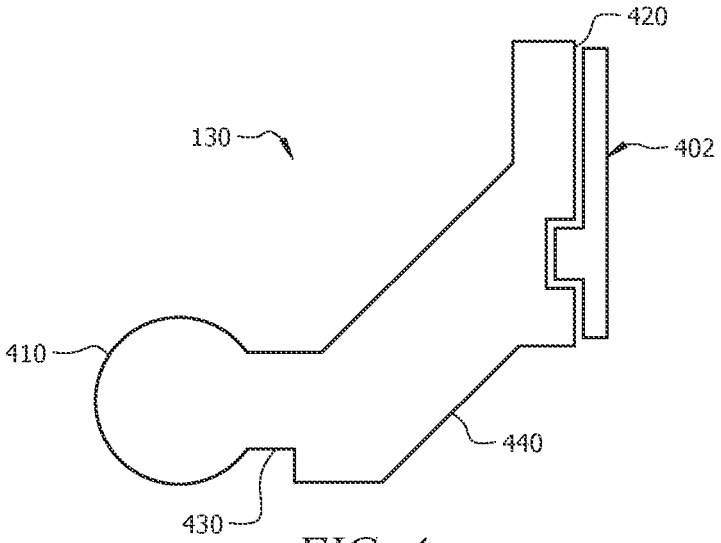
FIG. 4 is a schematic elevation view of one component of the inventive railing system.
Figure 5:
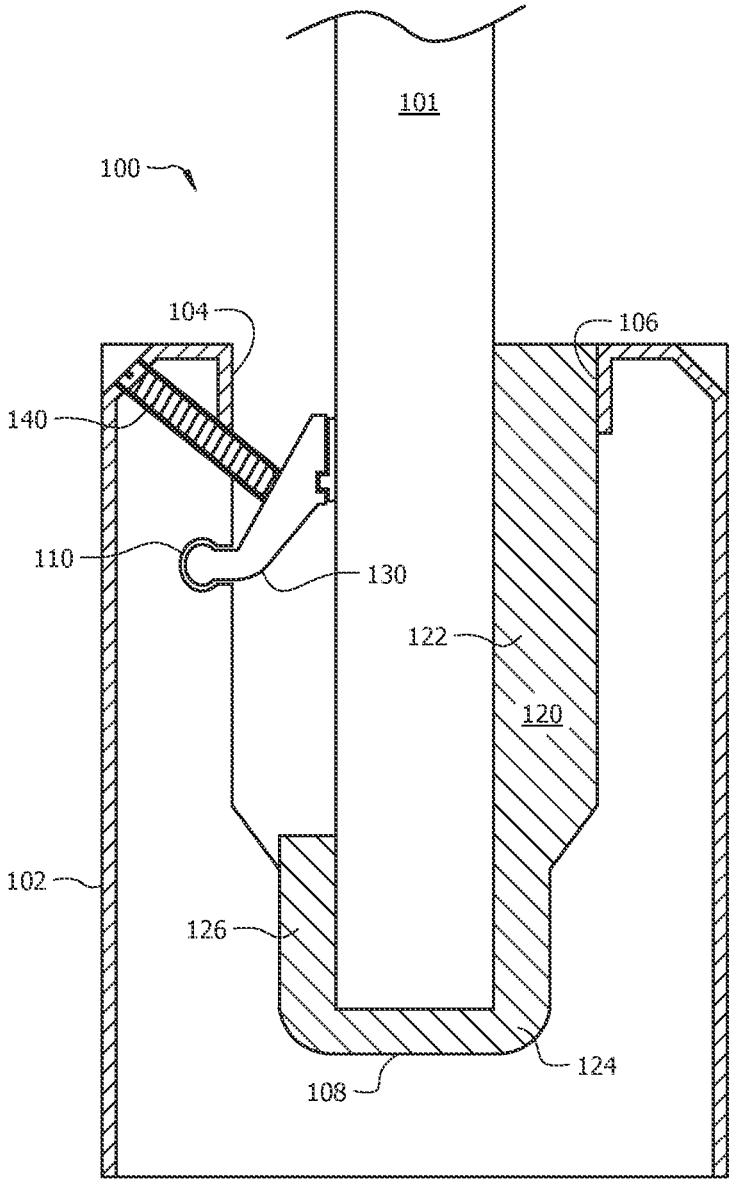
FIG. 5 is a schematic elevation view of an alternative embodiment of the inventive railing system.

Referring now to FIG. 4, the arm 130 has a rounded end 410 which rotatably mounts within the corresponding circular channel 110 in the first side wall 104. The rounded end 410 must be manufactured to lock in and slide-fit with the channel 110. The arm 130 also has a flat end 420 to engage the adjacent side of the panel 101. From the rounded end of the arm extends a short horizontal member 430, which is connected to an inclined member 440, from which the flat end 420 extends. The upper surface of the inclined member 440 is contacted by the set screws 140. As a user rotates the set screws 140 in a first direction, the screw applies a downward force to the inclined member 440 and causes the arm 130 to be rotated about the rounded end 410 within the groove and the flat end 420 of the arm 130 to engage and apply pressure to the adjacent side of the panel 101. Thus, the rounded end 410 acts as a pivot point.

One skilled in the art can determine the desired configuration and dimensions of the arm 130 based upon the design of the shoe 102 and panel 101. In one embodiment, the flat end 420 is about 0.3 to about 0.4 inches long. The length of the short horizontal member 430 is dependent upon the depth of the groove 110 within the first side wall 104, but is generally long enough to just clear the first side wall 104 such that the arm 130 is capable of sufficient rotation about the rounded end 410 to be manipulated to contact the panel 101 and apply the necessary force. The length of the inclined member 440 may be determined by one skilled in the art based upon the distance between the side wall 104 and the adjacent side of the panel 101, but in one embodiment, the length of the inclined member 440 is about 0.1 to about 0.2 inches. In one embodiment, the arm 130 is made of aluminum, but it may be constructed of any durable material known in the art. A pad 402, made of a malleable material, is preferably attached to the flat end 420 of the arm 130 to protect the panel 101 from scarring, scratching, or scoring from the arm 130.

An optional component for the railing system 100 is cladding for the external surfaces of the side walls 104, 106 to make the outer walls of the shoe more aesthetic and hide externally visible components such as the set screws. Additionally, guards may be placed between the internal surfaces of the side walls 104, 106 and the panel 101 to hide the internal components of the railing system 100. The guards are preferably made of a compliant material that will not scar, scratch, score or otherwise harm the aesthetics or integrity of the panel. These optional components are not shown in the Figures, but one skilled in the art will understand their use and can adapt the shoe 102 to utilize them.

To assemble the mounting system 100, the shoe 102 is placed in the desired location on the base floor and secured by means known in the art. The sleeve 120 is then inserted within the slot of the shoe 102. The arm 130 is raised and the panel 101 is fit within the sleeve 120. Once the panel 101 is laterally positioned as desired within the sleeve 120 and slot, the arm 130 is rotated about the rounded end 410 to lower the flat end 420 of the arm 130 to engage the adjacent side of the panel 101. The set screws 140 are then tightened, applying force to the inclined member 440 of the arm 130, and to the flat end 420 in turn, to securely hold the panel 101 in place. The optional cladding and guards are then put in place.

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A railing system for mounting a panel having a lower edge and two opposing, approximately parallel sides adjacent to said lower edge, said system comprising:

a) a shoe with an upward opening slot for receiving said panel, said slot having a first side wall spaced from a second side wall, and a lower wall extending between lower ends of the first and second side walls, said first side wall having therein a longitudinal circular channel extending along a length of and within said first side wall, the channel spaced away from the lower wall;

b) a sleeve for holding a panel when a lower edge of a panel is placed in said upward opening slot, said sleeve comprising a first vertical portion positioned adjacent the second side wall of said shoe, and a lower sleeve portion positioned adjacent the lower wall of said shoe;

c) an arm having a first end rotatably mounted within said longitudinal circular channel in said first side wall of said shoe, and the arm terminating in a flat surface on an opposite end, the flat surface configured for engaging a side of a panel, when a panel is clamped in the railing system; and d) a set screw extending diagonally downward through the first side wall of the shoe;

whereby, when a panel is to be located and clamped in the sleeve, the arm extends upward from the rotatably mounted first end in the circular channel, and urging of the set screw downward into contact with the arm pushes the arm downward and thereby urges the flat surface of the arm against a first side of the panel thereby urging an opposite side of the panel against the first vertical portion, which is in turn urged against the second side wall of the shoe, to thereby clamp the panel in a desired position in the railing system between the flat surface of the arm and the second side wall.

2. The railing system of claim 1 wherein said slot is generally U-shaped and further wherein said slot is wider at its opening than its terminal end.

3. The railing system of claim 2 wherein said opening of said slot is about 1.3-1.5 inches in width and said terminal of said slot is about 0.9-1.1 inches in width.

4. The railing system of claim 1 the center of said circular channel is set within said first side wall about 0.1-0.15 inches from the internal surface of said first side wall.

5. The railing system of claim 1 wherein the center of said circular channel is about 3.0-3.1 inches high on said first side wall.

6. The railing system of claim 1 wherein the diameter of said circular channel is about 0.2-0.3 inches.

7. The railing system of claim 1 wherein said sleeve further comprises a second vertical portion positioned between said first side wall of said shoe and the adjacent side of a panel, when a panel is fitted into the shoe.

8. The railing system of claim 1 wherein said first vertical portion of said sleeve extends the full height of said second side wall.

9. The railing system of claim 7 wherein a height of said second vertical portion of said sleeve is lower than the lower edge of said circular channel in said first side wall.

10. The railing system of claim 1 wherein a surface of said first vertical portion comprises at least one groove, the at least one groove configured to grip the second side wall.

11. The railing system of claim 1 wherein the arm comprises a longitudinal member extending from the first end to the opposite end of the arm, the first end comprising a rounded head, and the opposite end comprising a pad attached thereto to form the flat surface, the rounded head mounting rotatably within the circular channel of the first sidewall.

12. The railing system of claim 11 wherein the pad comprises a malleable pad.

13. The railing system of claim 12 wherein the railing system comprises spaced apart set screws.

14. The railing system of claim 13, wherein a surface of the first vertical portion comprises at least one groove, the at least one groove configured to grip the second side wall.

15. The railing system of claim 11 wherein said sleeve further comprises a second vertical portion positioned between said first side wall of said shoe and the adjacent side of a panel, when the panel is fitted into the shoe.

16. The railing system of claim 15, wherein the railing system comprises spaced apart set screws.

17. The railing system of claim 1 comprising spaced apart set screws.

18. The railing system of claim 1 comprising a set screw of about 20 mm in length.

19. The railing system of claim 1 wherein said shoe and arm are comprised of aluminum.

20. The railing system of claim 1 wherein said sleeve is comprised of plastic.

* * * * *